US008907651B2

(12) United States Patent
Reddy et al.

(10) Patent No.: US 8,907,651 B2
(45) Date of Patent: Dec. 9, 2014

(54) POWER SUPPLY CIRCUIT FOR REDUCED WAKE-UP TIME

(75) Inventors: Morthala V Narsi Reddy, Noida (IN); Kushal Kamal, Noida (IN); Samaksh Sinha, Noida (IN)

(73) Assignee: Freescale Semiconductor, Inc., Austin, TX (US)

( * ) Notice: Subject to any disclaimer, the term of this patent is extended or adjusted under 35 U.S.C. 154(b) by 465 days.

(21) Appl. No.: 13/370,282

(22) Filed: Feb. 9, 2012

(65) Prior Publication Data

US 2013/0207635 A1 Aug. 15, 2013

(51) Int. Cl.
*G05F 3/16* (2006.01)

(52) U.S. Cl.
USPC ..... 323/313; 323/273

(58) Field of Classification Search
USPC ..... 323/268, 274, 281, 284, 293, 312, 313, 323/314, 273
See application file for complete search history.

(56) References Cited

U.S. PATENT DOCUMENTS

| | | | | |
|---|---|---|---|---|
| 5,563,504 | A * | 10/1996 | Gilbert et al. | 323/316 |
| 6,958,596 | B1 * | 10/2005 | Sferrazza et al. | 323/303 |
| 7,190,150 | B2 * | 3/2007 | Chen et al. | 323/222 |
| 7,723,867 | B2 | 5/2010 | Willingham | |
| 7,783,908 | B2 | 8/2010 | Bogovac | |
| 8,074,086 | B1 | 12/2011 | Sancheti | |
| 8,258,766 | B1 * | 9/2012 | Sutardja | 323/282 |
| 8,610,417 | B1 * | 12/2013 | Sutardja | 323/282 |
| 2003/0011247 | A1 * | 1/2003 | Kajiwara et al. | 307/125 |
| 2005/0091629 | A1 | 4/2005 | Eisenstadt | |
| 2007/0016313 | A1 | 1/2007 | Abe | |
| 2007/0152646 | A1 | 7/2007 | Godil | |
| 2011/0158303 | A1 | 6/2011 | Gauthier | |
| 2011/0210709 | A1 | 9/2011 | Mounier | |
| 2011/0213992 | A1 | 9/2011 | Satsangi | |

* cited by examiner

*Primary Examiner* — Jue Zhang
*Assistant Examiner* — Lakaisha Jackson
(74) *Attorney, Agent, or Firm* — Charles Bergere

(57) ABSTRACT

An electronic circuit includes a switchable circuit domain that operates in a RUN mode and a STANDBY mode and receives a supply current from a core power supply. A power regulator is connected between the core power supply and the switchable circuit domain to regulate the supply current provided to the switchable circuit domain when the electronic circuit is in the RUN mode. A capacitor is connected between the power regulator and ground and is charged by a refresh circuit when the electronic circuit is in the STANDBY mode. The refresh circuit maintains a voltage across the capacitor when the electronic circuit is in the standby mode, which reduces the time for the electronic circuit to transition from the STANDBY mode to the RUN mode.

16 Claims, 3 Drawing Sheets

- PRIOR ART -

POWER SUPPLY CIRCUIT FOR REDUCED WAKE-UP TIME

BACKGROUND OF THE INVENTION

The present invention relates generally to electronic circuits, and more particularly, to power supply circuits used in electronic circuits.

Electronic circuits such as microprocessors, microcontroller units (MCUs), system-on-chips (SOCs), and application specific integrated circuits (ASICs) are used in a wide variety of applications such as industrial applications, automobiles, home appliances, and handheld devices. These circuits often operate in different power modes such as a RUN mode, a STANDBY mode, and a STOP mode. An example of a conventional electronic circuit 100 is illustrated in FIG. 1. The electronic circuit 100 includes an always ON circuit domain 102, a switchable circuit domain 104, a low power regulator 106, a power regulator 108, and a capacitor 110. The always ON circuit domain 102 receives a constant supply current from the low power regulator 106 and operates in a single mode, i.e., the RUN mode. The switchable circuit domain 104 can operate in a RUN mode and a STANDBY mode. The switchable circuit domain 104 receives a constant supply current in the RUN mode and the supply current is gated in the STANDBY mode. The STOP mode is common to both circuit domains 102, 104, in which case the power supply is shut off.

The switchable circuit domain 104 receives a supply current from a core power supply 112 in the RUN mode. The power regulator 108 is connected to the core power supply 112 and the switchable circuit domain 104 and regulates the supply current to the switchable circuit domain 104. The power regulator 108 is a high power regulator and includes a band gap voltage source 114, a buffer amplifier 116, and a switch 118, such as a p-channel metal oxide semiconductor (PMOS) transistor. The capacitor 110 is connected between the power regulator 108 and ground. The negative terminal of the buffer amplifier 116 is connected to the band gap voltage source 114 and the positive terminal of the buffer amplifier 116 is connected to a first terminal of the capacitor 110. The switch 118 is connected to the output terminal of the buffer amplifier 116, the core power supply 112 and the switchable circuit domain 104.

When the switchable circuit domain 104 transitions from the STANDBY mode to the RUN mode, the capacitor 110 must be charged to a predetermined voltage. The band gap voltage source 114 generates a voltage equivalent to this predetermined voltage (e.g., 1.2v). During the transition, the capacitor 110 is charged by the core power supply 112 and the voltage across the capacitor 110 appears at the positive terminal of the buffer amplifier 116. The initial output of the buffer amplifier 116 is about 3.3V and the switch 118, which is OFF, gates the supply current to the switchable circuit domain 104. While the capacitor 110 is charging, the buffer amplifier 116 compares the voltage across the capacitor 110 with the voltage generated by the band gap voltage source 114 and controls the ON/OFF status of the switch 118. The output of the buffer amplifier 116 gradually decreases from 3.3V to a LOW state and remains LOW as long as the voltage across the capacitor 110 is less than the voltage generated by the band gap voltage source 114. The LOW output of the buffer amplifier 116 turns the switch 118 ON and then the supply current is directed from the core power supply 112 to the switchable circuit domain 104. When the capacitor 110 is charged to the predetermined voltage, the output of the buffer amplifier 116 goes HIGH, which causes the switch 118 to enter a saturation state and thus continue conducting.

The time for the switchable circuit domain 104 to transition from the STANDBY mode to the RUN mode is known as wake-up time. The wake-up time is a function of the time taken by the capacitor 110 to be charged to the predetermined voltage. When used in automotive electronic circuits, the capacitance of the capacitor 110 can be as high as 40 microfarads (μF). The time for such a capacitor to charge to about 1.2v ranges between 400-500 microseconds. This high wake-up time degrades the performance of the electronic circuit 100.

The wake-up time can be crucial when such electronic circuits are used in time critical applications and should be as low as possible to reduce the chances of failure of the electronic circuit. One solution to reduce the wake-up time is to increase the in-rush current to the capacitor 110 (from the core power supply 112) when the switchable circuit domain 104 transitions from the RUN mode to the STANDBY mode. However, an increase in the in-rush current causes a decrease in the supply level to the switchable circuit domain 104, and decrease in supply level leads to a low voltage condition in the switchable circuit domain 104, which will trigger low voltage detectors (LVDs) and cause a system level interrupt. Such a situation is unwanted during the operation of the electronic circuit. Further, additional circuitry must be added to the electronic circuit 100 to mask the false triggering of the LVDs, which increases the size of the electronic circuit 100.

It would be advantageous to have an electronic circuit with a reduced wake-up time and that does not trigger system level interrupts.

BRIEF DESCRIPTION OF THE DRAWINGS

The following detailed description of the preferred embodiments of the present invention will be better understood when read in conjunction with the appended drawings. The present invention is illustrated by way of example, and not limited by the accompanying figures, in which like references indicate similar elements.

DETAILED DESCRIPTION OF THE PRESENT INVENTION

Figure 1:
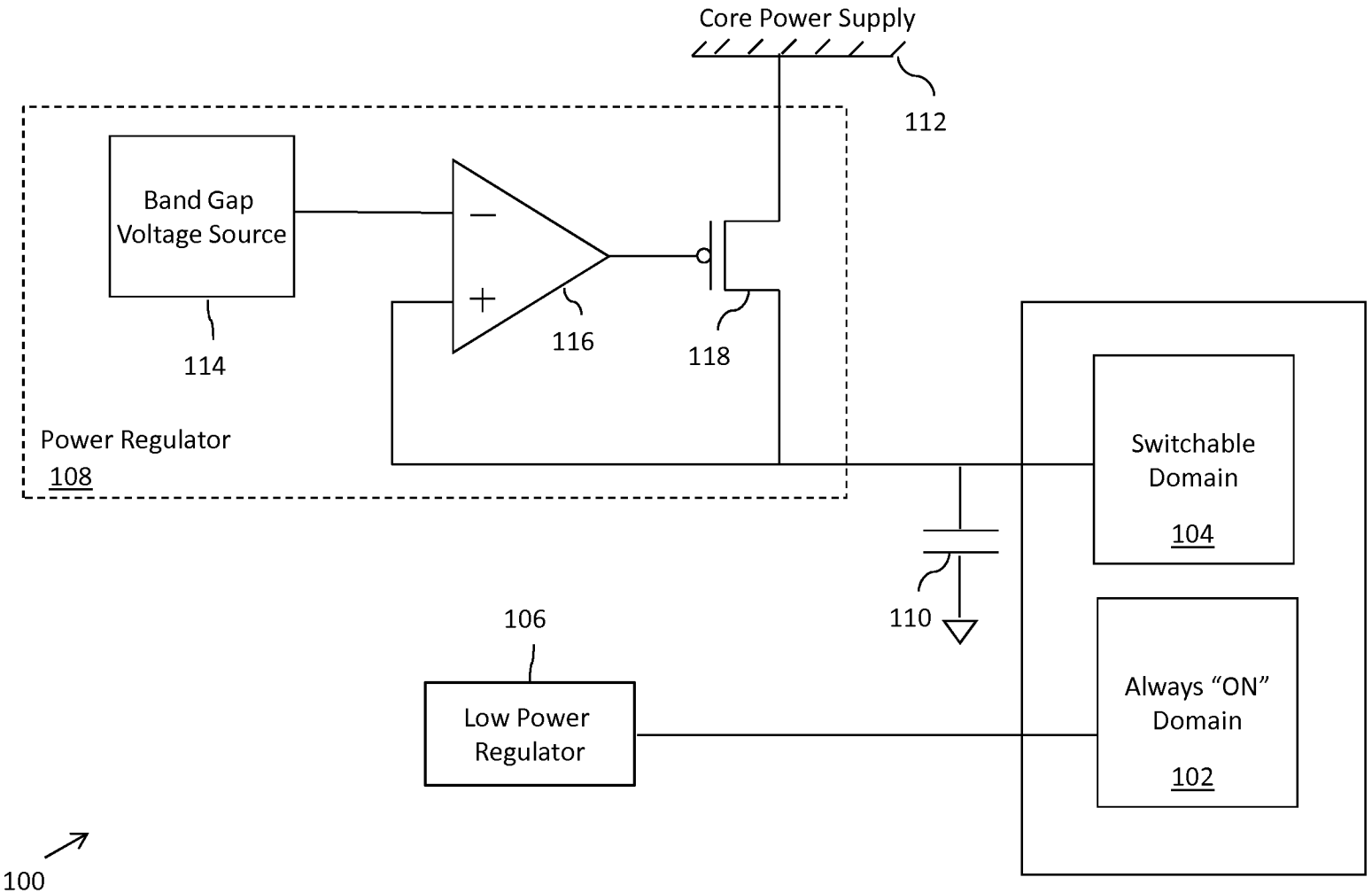
FIG. 1 is a schematic block diagram of a conventional electronic circuit.

The detailed description of the appended drawings is intended as a description of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention.

In an embodiment of the present invention, a power supply circuit for providing a supply current to an electronic circuit is provided. The electronic circuit operates in a RUN mode and a STANDBY mode and receives a supply current in the RUN mode. The power supply circuit includes a power regulator, a capacitor and a refresh circuit. The power regulator is connected between a core power supply and the electronic circuit and regulates the supply current provided to the electronic circuit in the RUN mode. A first terminal of the capacitor is connected to the power regulator and a second terminal is connected to ground. The capacitor is charged to a predetermined voltage by the core power supply when the electronic circuit transitions from the STANDBY mode to the RUN mode. The refresh circuit includes a first band gap voltage source and a first buffer amplifier. The first band gap voltage source generates a voltage equivalent to the predetermined voltage. An input terminal of the first buffer amplifier is connected to the first band gap voltage source and an output terminal is connected to an inverted input terminal of the first buffer amplifier and to the first terminal of the capacitor. The refresh circuit maintains a voltage across the capacitor at about the predetermined voltage in the STANDBY mode, which reduces the time for the electronic circuit to transition from the STANDBY mode to the RUN mode.

In another embodiment of the present invention, an electronic circuit that has a circuit domain that operates in a run mode and a standby mode and receives a supply current from a core power supply when in the RUN mode is provided. A power regulator is connected between the core power supply and the circuit domain for regulating the supply current provided to the circuit domain when the circuit domain is in the RUN mode. A first terminal of the capacitor is connected to the power regulator and a second terminal is connected to ground. The capacitor is charged to a predetermined voltage by the core power supply when the circuit domain transitions from the STANDBY mode to the RUN mode. The refresh circuit includes a first band gap voltage source and a first buffer amplifier. The first band gap voltage source generates a voltage equivalent to the predetermined voltage. An input terminal of the first buffer amplifier is connected to the first band gap voltage source and an output terminal is connected to an inverted input terminal of the first buffer amplifier and to the first terminal of the capacitor. The refresh circuit maintains a voltage across the capacitor at about the predetermined voltage in the STANDBY mode, which reduces the time for the circuit domain to transition from the STANDBY mode to the RUN mode.

In yet another embodiment of the present invention, the power regulator is enabled when the circuit domain is in the RUN mode and disabled when the circuit domain is in the STANDBY mode, based on a power regulator control signal. A first terminal of the capacitor is connected to the power regulator and a second terminal is connected to the ground. The capacitor is charged to a predetermined voltage by the core power supply when the circuit domain transitions from the STANDBY mode to the RUN mode. The refresh circuit includes a first band gap voltage source and a first buffer amplifier. The first band gap voltage source generates a voltage equivalent to the predetermined voltage. An input terminal of the first buffer amplifier is connected to the first band gap voltage source and an output terminal is connected to an inverted input terminal of the first buffer amplifier and to the first terminal of the capacitor. The refresh circuit maintains a voltage across the capacitor at about the predetermined voltage in the STANDBY mode, which reduces the time for the circuit domain to transition from the STANDBY mode to the RUN mode.

The electronic circuit further includes first and second switches. The first switch is connected between the refresh circuit and the first terminal of the capacitor, for connecting the refresh circuit to the capacitor when the circuit domain is in the STANDBY mode. The second switch is connected to the refresh circuit and the first switch, for receiving the power regulator control signal and an oscillator signal and controlling the second switch. The power regulator includes a second band gap voltage source for generating the predetermined voltage and a second buffer amplifier having an input terminal connected to the first terminal of the capacitor and an inverted input terminal connected to the second band gap voltage source. A third switch is connected to an output terminal of the second buffer amplifier, the core power supply and the circuit domain, for conducting the supply current from the core power supply to the circuit domain.

Various embodiments of the present invention provide an electronic circuit with a reduced wake-up time. The electronic circuit includes a switchable circuit domain that operates in a RUN mode and a STANDBY mode and receives a regulated supply current from a power regulator in the RUN mode. The electronic circuit further includes a capacitor that needs to be charged to a predetermined voltage when the switchable circuit domain transitions from the STANDBY mode to the RUN mode. A refresh circuit keeps the capacitor charged to about the predetermined voltage when the switchable circuit domain is in the STANDBY mode. Thus, the switchable circuit domain quickly transitions from the STANDBY mode to the RUN mode, i.e., the wake-up time is reduced and the performance of the electronic circuit is improved.

As the capacitor is already charged in the STANDBY mode, it draws little in-rush current from the core power supply when the switchable circuit domain transitions from the STANDBY mode to the RUN mode. Adequate current is supplied to the switchable circuit domain to avoid a low voltage condition and prevent false triggering of low voltage detectors (LVDs). As a result, the electronic circuit does not require additional circuitry for masking the LVDs.

Figure 2:
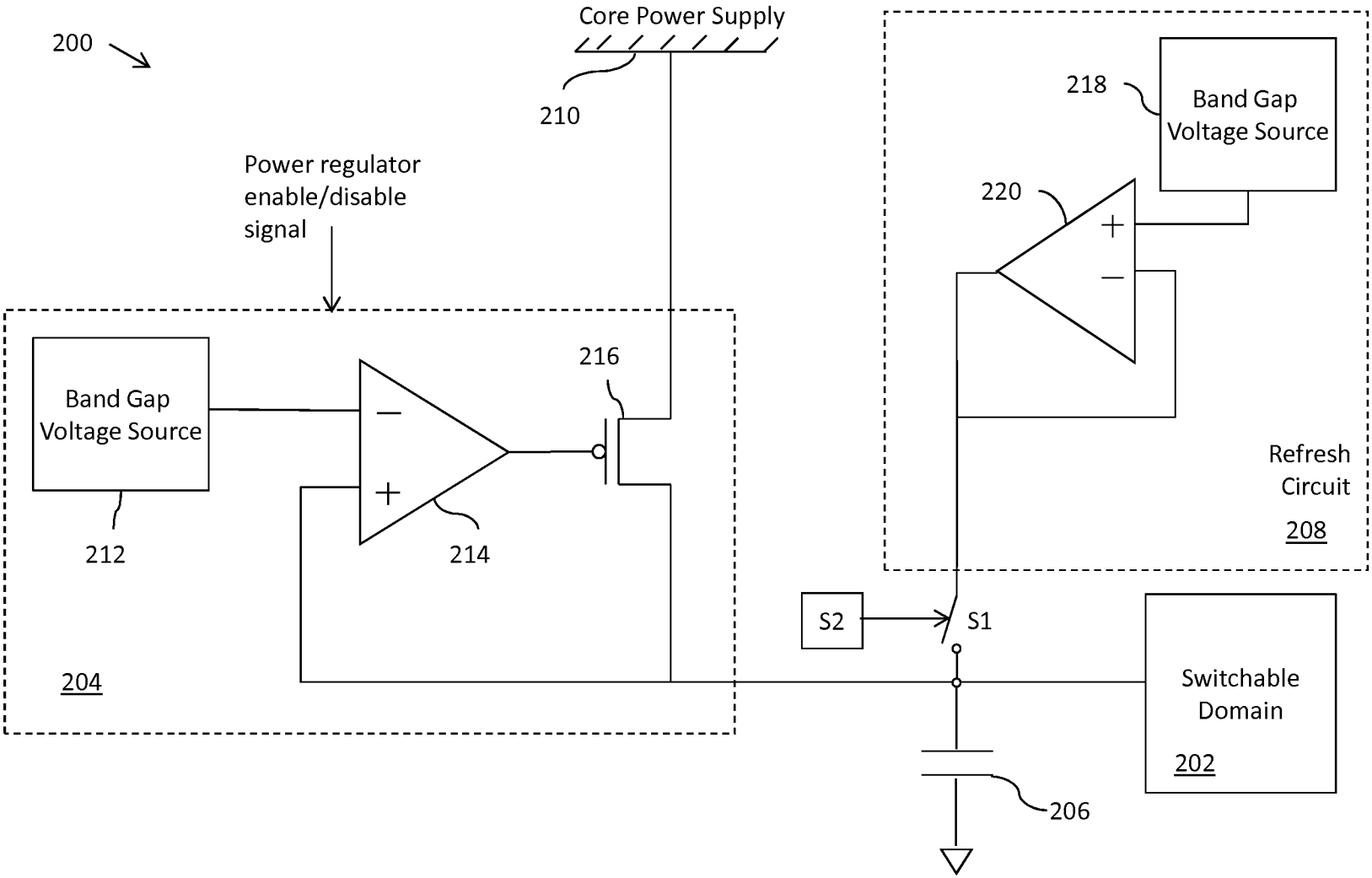
FIG. 2 is a schematic block diagram of an electronic circuit in accordance with an embodiment of the present invention.

Referring now to FIG. 2, a schematic diagram of an electronic circuit 200 in accordance with an embodiment of the present invention, is shown. The electronic circuit 200 includes a switchable circuit domain 202, a power regulator 204, a capacitor 206 and a refresh circuit 208. The electronic circuit 200 may be a microprocessor, a microcontroller, a system-on-chip (SoC), an application specific integrated circuit (ASIC), or the like. The electronic circuit 200 also includes an "always ON" circuit domain (not shown). The power regulator 204, the capacitor 206, and the refresh circuit 208 collectively form a power supply circuit.

The switchable circuit domain 202 receives a supply current from a core power supply 210 when it is operating in the RUN mode. The power regulator 204 is connected between the core power supply 210 and the switchable circuit domain 202 and regulates the supply current provided to the switchable circuit domain 202. In various embodiments of the present invention, the power regulator 204 is a high power regulator and includes a first band gap voltage source 212, a first buffer amplifier 214 and a switch 216. The switch 216 may be a PMOS transistor. The capacitor 206 is connected between the power regulator 204 and ground. The negative terminal of the first buffer amplifier 214 is connected to the first band gap voltage source 212 and the positive terminal of the first buffer amplifier 214 is connected to a first terminal of the capacitor 206. The switch 216 is connected to the output terminal of the first buffer amplifier 214, the core power supply 210 and the switchable circuit domain 202.

The operation of the "always ON" circuit domain, the switchable circuit domain 202, the power regulator 204, the capacitor 206, the first band gap voltage source 212, the first buffer amplifier 214 and the switch 216 are similar to the corresponding components of the electronic circuit 100 of FIG. 1 so will not be described in further detail.

To reduce the wake-up time of the switchable circuit domain 202, the electronic circuit 200 includes the refresh circuit 208. The refresh circuit 208 includes a second band gap voltage source 218 and a second buffer amplifier 220. The positive terminal of the second buffer amplifier 220 is connected to the second band gap voltage source 218 and the negative terminal of the second buffer amplifier 220 is connected to the output terminal of the second buffer amplifier 220. The output terminal also is connected to the first terminal of the capacitor 206 by way of a first switch S1.

The first switch S1 is used to enable/disable the connection between the refresh circuit 208 and the capacitor 206. A second switch, S2, is connected to the second buffer amplifier 220 and the first switch S1. The second switch S2 controls the switching operation of the first switch S1.

When the switchable circuit domain 202 enters the STANDBY mode, the power regulator 204 is disabled by a power regulator enable/disable signal (which goes HIGH). The second switch S2 also receives the power regulator enable/disable signal and switches the first switch S1 to an ON state and enables the second buffer amplifier 220. The first switch S1 connects the refresh circuit 208 (i.e., the output terminal of the second buffer amplifier 220) to the first terminal of the capacitor 206 so that the second band gap voltage source 218 can start charging the capacitor 206. In a preferred embodiment of the invention, the second buffer amplifier 220 is a unity gain amplifier. The second band gap voltage source 218 is configured to generate a voltage equivalent to the predetermined voltage (e.g., 1.2V). The voltage across the capacitor 206 appears at the negative terminal of the second buffer amplifier 220 and the output of the second buffer amplifier 220 remains HIGH as long as the voltage across the capacitor 206 is less than the voltage generated by the second band gap voltage source 218, i.e., the predetermined voltage. The output of the second buffer amplifier 220 goes LOW when the voltage across the capacitor 206 becomes slightly higher than the predetermined voltage and the charging of the capacitor 206 stops. The charging resumes when the voltage across the capacitor 206 drops below the predetermined voltage and this cycle continues while the switchable circuit domain is in the STANDBY mode. Thus, the capacitor 206 is kept charged at about the predetermined voltage.

When the switchable circuit domain 202 transitions from the STANDBY mode to the RUN mode, the power regulator enable/disable signal switches to a LOW state and enables the power regulator 204. The LOW power regulator enable/disable signal further causes the second switch S2 to turn the first switch S1 ON and also disables the second buffer amplifier 220. As the voltage across the capacitor 206 is about equal to the predetermined voltage, the output of the first buffer amplifier 214 immediately switches to a HIGH state, which causes the switch 216 to reach the saturation state. The switch 216 starts conducting the supply current from the core power supply 210 to the switchable circuit domain 202 and the switchable circuit domain 202 enters the RUN mode. The wake-up time of the switchable circuit domain 202 is reduced because it can receive current from the capacitor as soon as it transitions from STANDBY to RUN.

Figure 3B:
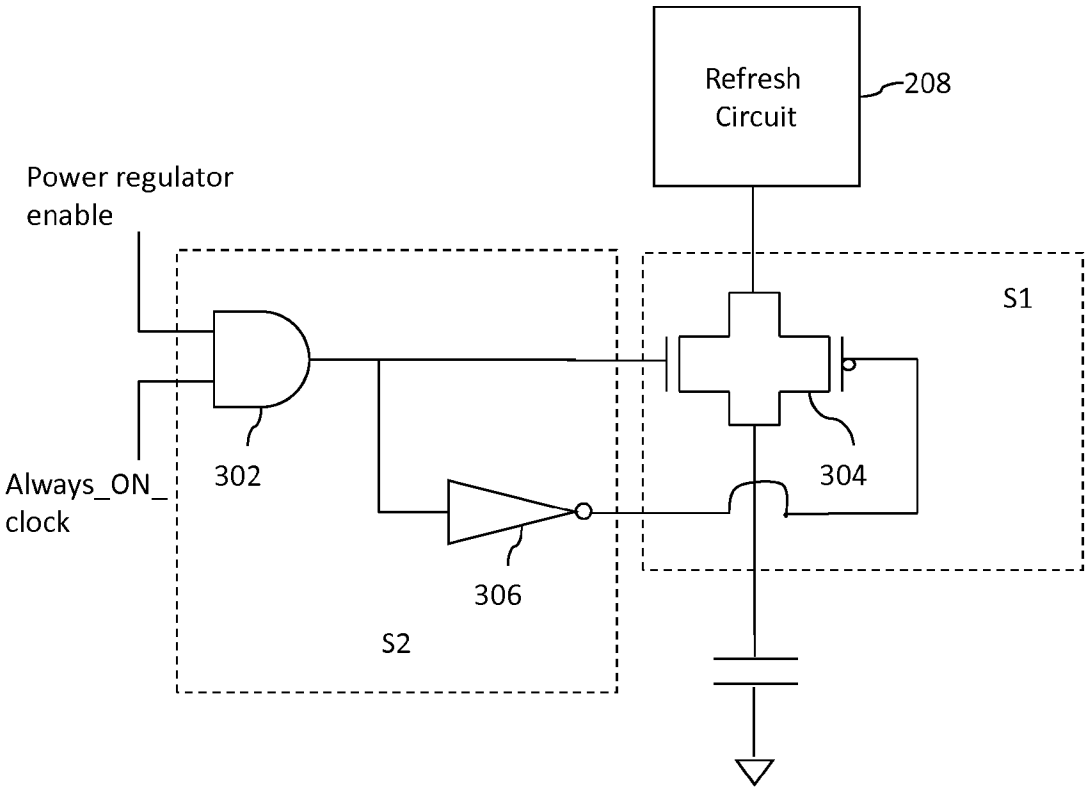
FIGS. 3A and 3B are schematic block diagrams illustrating exemplary implementations of switches in accordance with an embodiment of the present invention.
Figure 3A:
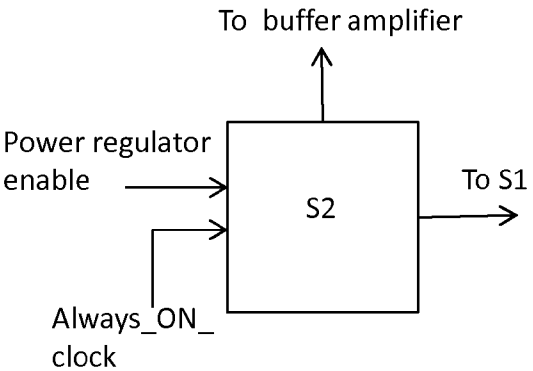

A schematic block diagram of an embodiment of the second switch S2 is illustrated in FIG. 3A. The second switch S2 receives the power regulator enable/disable signal and an externally generated "always ON" oscillator or clock signal (Always_ON_clock). The frequency of the oscillator signal determines the switching frequency of the second switch S2. It is preferred to keep the switching frequency at an optimum level to reduce wear and tear on the refresh circuit 208 caused by the loading of the second band gap voltage source 218. In an embodiment of the present invention, the second switch S2 is switched ON during a positive cycle of the oscillator signal and switched OFF during a negative cycle of the oscillator signal. In an exemplary embodiment, the frequency of the oscillator signal is 32 KHz. The second switch S2 generates output signals to control the switching operations of the first switch S1 and the second buffer amplifier 220.

Exemplary implementations of the first and second switches S1 and S2 in accordance with an embodiment of the present invention are illustrated in FIG. 3B. The second switch S2 includes an AND gate 302 that receives the power regulator enable/disable signal and the oscillator signal at its input terminals. The first switch S1 may be a transmission gate (or an analog switch) 304 that is implemented using PMOS and NMOS transistors. The control gates of the MOS transistors are biased in a complementary manner using the output and an inverted output of the AND gate 302, such that both transistors are either ON or OFF. The inverted output signal of the AND gate is obtained with a NOT gate 306.

When the power regulator enable/disable signal is HIGH, in the STANDBY mode, the output of the AND gate 302 switches to a HIGH state and causes the transmission gate 304 to conduct from the refresh circuit 208 to the capacitor 206. When the power regulator enable/disable signal is LOW, in the RUN mode, the output of the AND gate 302 switches to a LOW state and causes the transmission gate 304 to gate the refresh circuit 208 from the capacitor 206.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

The invention claimed is:

1. A power supply circuit for providing a supply current to an electronic circuit, wherein the electronic circuit operates in a run mode and a standby mode and receives the supply current in the run mode, the power supply circuit comprising;

a power regulator, connected to a core power supply and the electronic circuit, for regulating the supply current provided to the electronic circuit when the electronic circuit is in the run mode;

a capacitor having a first terminal connected to the power regulator and a second terminal connected to ground, wherein the capacitor is charged to a predetermined voltage level by the core power supply when the electronic circuit transitions from the standby mode to the run mode;

a refresh circuit, comprising:

a first band gap voltage source for generating a voltage equivalent to the predetermined voltage level; and a first buffer amplifier having an input terminal connected to the first band gap voltage source and an output terminal connected to an inverted input terminal of the first buffer amplifier and to the first terminal of the capacitor;

a first switch, connected between the refresh circuit and the first terminal of the capacitor, for connecting the refresh circuit to the capacitor when the electronic circuit is in the standby mode; and a second switch, connected to the refresh circuit and the first switch, for receiving a power regulator control signal and an oscillator signal, and controlling the first switch;

wherein the refresh circuit maintains a voltage across the capacitor at about the predetermined voltage level when the electronic circuit is in the standby mode, thereby reducing time for the electronic circuit to transition from the standby mode to the run mode.

2. The power supply circuit of claim 1, wherein the power regulator is enabled when the electronic circuit is in the run mode and disabled when the electronic circuit is in the standby mode, based on the power regulator control signal.

3. The power supply circuit of claim 1, wherein the second switch further enables the first buffer amplifier when the electronic circuit is in the standby mode and disables the first buffer amplifier when the electronic circuit is in the run mode.

4. The power supply circuit of claim 1, wherein the power regulator comprises:

a second band gap voltage source for generating the predetermined voltage; and a second buffer amplifier having an input terminal connected to the first terminal of the capacitor and an inverted input terminal connected to the second band gap voltage source; and a third switch connected to an output terminal of the second buffer amplifier, the core power supply and the electronic circuit, for conducting the supply current from the core power supply to the electronic circuit.

5. The power supply circuit of claim 4, wherein the third switch is a metal-oxide semiconductor (MOS) switch.

6. The power supply circuit of claim 1, wherein the first buffer amplifier is a unity gain amplifier.

7. An electronic circuit, comprising:

a circuit domain that operates in a run mode and a standby mode and receives a supply current from a core power supply when in the run mode;

a power regulator, connected to the core power supply and the circuit domain, for regulating the supply current provided to the circuit domain when the circuit domain is in the run mode;

a capacitor having a first terminal connected to the power regulator and a second terminal connected to ground, wherein the capacitor is charged to a predetermined voltage by the core power supply when the circuit domain transitions from the standby mode to the run mode;

a refresh circuit comprising:

a first band gap voltage source for generating a voltage equivalent to the predetermined voltage; and a first buffer amplifier having an input terminal connected to the first band gap voltage source and an output terminal connected to an inverted input terminal of the first buffer amplifier and to the first terminal of the capacitor;

a first switch, connected between the refresh circuit and the first terminal of the capacitor, for connecting the refresh circuit to the capacitor when the circuit domain is in the standby mode; and a second switch, connected to the refresh circuit and the first switch, for receiving a power regulator control signal and an oscillator signal, and controlling the second switch;

wherein the refresh circuit maintains a voltage across the capacitor at about the predetermined voltage when the circuit domain is in the standby mode, which allows the circuit domain to quickly transition from the standby mode to the run mode.

8. The electronic circuit of claim 7, wherein the power regulator is enabled when the circuit domain is in the run mode and disabled when the circuit domain is in the standby mode, based on the power regulator control signal.

9. The electronic circuit of claim 7, wherein the second switch further enables the first buffer amplifier when the circuit domain is in the standby mode and disables the first buffer amplifier when the circuit domain is in the run mode.

10. The electronic circuit of claim 7, wherein the power regulator comprises:

a second band gap voltage source for generating the predetermined voltage; and a second buffer amplifier having an input terminal connected to the first terminal of the capacitor and an inverted input terminal connected to the second band gap voltage source; and a third switch connected to an output terminal of the second buffer amplifier, the core power supply and the circuit domain, for conducting the supply current from the core power supply to the circuit domain.

11. The electronic circuit of claim 10, wherein the third switch is a metal-oxide semiconductor (MOS) switch.

12. The electronic circuit of claim 7, wherein the first buffer amplifier is a unity gain amplifier.

13. An electronic circuit, comprising:

a circuit domain that operates in a run mode and a standby mode and receives a supply current from a core power supply when in the run mode;

a power regulator, connected to the core power supply and the circuit domain, for regulating the supply current provided to the circuit domain when the circuit domain is in the run mode;

a capacitor having a first terminal connected to the power regulator and a second terminal connected to ground, wherein the capacitor is charged to a predetermined voltage by the core power supply when the circuit domain transitions from the standby mode to the run mode;

a refresh circuit, comprising:

a first band gap voltage source for generating a voltage equivalent to the predetermined voltage;

a first buffer amplifier having an input terminal connected to the first band gap voltage source and an output terminal connected to an inverted input terminal of the first buffer amplifier and to the first terminal of the capacitor; and wherein the refresh circuit maintains a voltage across the capacitor at about the predetermined voltage when the circuit domain is in the standby mode, thereby reducing time taken by the circuit domain to transition from the standby mode to the run mode, and wherein the power regulator is enabled when the circuit domain is in the run mode and disabled when the circuit domain is in the standby mode, based on a power regulator control signal;

a first switch, connected between the refresh circuit and the first terminal of the capacitor, for connecting the refresh circuit to the capacitor when the circuit domain is in the standby mode; and a second switch, connected to the refresh circuit and the first switch, for receiving the power regulator control signal and an oscillator signal and controlling the second switch, wherein the power regulator comprises:

a second band gap voltage source for generating the predetermined voltage; and a second buffer amplifier having an input terminal connected to the first terminal of the capacitor and an inverted input terminal connected to the second band gap voltage source; and a third switch connected to an output terminal of the second buffer amplifier, the core power supply and the circuit domain, for conducting the supply current from the core power supply to the circuit domain.

14. The electronic circuit of claim 13, wherein the second switch further enables the first buffer amplifier when the circuit domain is in the standby mode and disables the first buffer amplifier when the circuit domain is in the run mode.

15. The electronic circuit of claim 13, wherein the third switch is a metal-oxide semiconductor (MOS) switch.

16. The electronic circuit of claim 13, wherein the first buffer amplifier is a unity gain amplifier.

* * * * *